US006518005B2

(12) United States Patent
Cavalleri et al.

(10) Patent No.: US 6,518,005 B2
(45) Date of Patent: Feb. 11, 2003

(54) SILVER HALIDE MULTILAYER COLOR PHOTOGRAPHIC MATERIAL

(75) Inventors: Piero Cavalleri, Pieve Di Teco (IT); Raffaella Biavasco, Savona (IT); Stefano Parodi, Pont Saint Martin (IT)

(73) Assignee: Ferrania, S.p.A. (IT)

( * ) Notice: Subject to any disclaimer, the term of this patent is extended or adjusted under 35 U.S.C. 154(b) by 12 days.

(21) Appl. No.: 09/877,467

(22) Filed: Jun. 8, 2001

(65) Prior Publication Data

US 2002/0031735 A1 Mar. 14, 2002

(30) Foreign Application Priority Data

Jul. 7, 2000 (IT) ..... SV2000A31

(51) Int. Cl.[7] ..... G03C 1/46

(52) U.S. Cl. ..... 430/506; 430/510; 430/517; 430/522

(58) Field of Search ..... 430/502, 503, 430/506, 510, 517, 522

(56) References Cited

U.S. PATENT DOCUMENTS

| | | | | |
|---|---|---|---|---|
| 2,538,008 A | | 1/1951 | Keyes et al. | 260/465 |
| 2,538,009 A | | 1/1951 | Keyes et al. | 95/8 |
| 4,234,677 A | | 11/1980 | Postle | 430/518 |
| 4,420,555 A | | 12/1983 | Krueger et al. | 430/507 |
| 4,861,700 A | | 8/1989 | Shuttleworth et al. | 430/517 |
| 4,923,788 A | | 5/1990 | Shuttleworth et al. | 430/507 |
| 5,296,344 A | | 3/1994 | Jimbo et al. | 430/522 |
| 5,298,377 A | | 3/1994 | Bowne | 430/507 |
| 5,449,594 A | | 9/1995 | Ueda et al. | 430/504 |
| 5,538,836 A | | 7/1996 | Ueda et al. | 430/505 |
| 5,776,667 A | | 7/1998 | Ohlschlager et al. | 430/517 |
| 6,033,841 A | * | 3/2000 | Bell et al. | 430/517 |
| 6,045,985 A | | 4/2000 | Cavalleri et al. | 430/507 |
| 6,225,037 B1 | * | 5/2001 | Buitano et al. | 430/503 |

FOREIGN PATENT DOCUMENTS

| | | |
|---|---|---|
| EP | 0 382 225 B1 | 11/1994 |
| EP | 0 697 758 A2 | 2/1996 |
| EP | 0 930 536 A1 | 7/1999 |
| GB | 695873 | 8/1953 |
| GB | 760739 | 11/1956 |

* cited by examiner

*Primary Examiner*—Geraldine Letscher
(74) *Attorney, Agent, or Firm*—Mark A. Litman & Assoc. P.A.

(57) ABSTRACT

The present invention refers to photographic elements having, coated on a support base, at least one silver halide emulsion layer sensitized to a radiation different from the blue one in addition to its intrinsic sensitivity to the blue region, and a yellow filter layer positioned between said at least one silver halide emulsion layer and the exposure source, where such yellow filter layer contains a yellow filtering dye represented by the formula (1):

formula (1)

wherein R and $R_1$ each independently represent a hydrogen atom, a substituted or unsubstituted alkyl group, a substituted or unsubstituted alkylene group, a substituted or unsubstituted heterocyclic group or a substituted or unsubstituted aryl group; $R_2$, $R_3$ and $R_4$ each independently represent a hydrogen atom, a substituted or unsubstituted alkyl group, a substituted or unsubstituted aryl group and $R_3$ and $R_4$ may be combined to form a 6-membered ring.

6 Claims, No Drawings

SILVER HALIDE MULTILAYER COLOR PHOTOGRAPHIC MATERIAL

BACKGROUND OF THE INVENTION

1. Field of the Invention

The present invention refers to light sensitive silver halide color photographic elements containing yellow filtering dyes and, more particularly, to light sensitive silver halide color photographic elements where one or more light sensitive layers are protected against blue light exposure with a layer containing a yellow filtering dye.

2. Background of the Art

Light-sensitive silver halide color photographic elements, which make use of subtractive processing to reproduce color, are known to comprise silver halide emulsion layers which are selectively sensitive to blue, to green and to red light and are associated with yellow-dye, magenta-dye and cyan-dye forming couplers, respectively, which (after exposure and reaction with a p-phenylene diamine-type oxidized developer) form their own complementary color. For instance, an acetylanilide-type coupler is used to form a yellow-colored image, a 5-pyrazolone-, pyrazolotriazole-, cyanoacetophenone- or indazolone-type coupler is used to form a magenta-colored image; and a phenol-type coupler, and phenol or naphthol as well, is used to form a cyan-colored image.

Generally, light-sensitive color photographic elements comprise non-diffusing couplers independently incorporated in each of the light sensitive layers of the material (incorporated coupler material). Thus, a light-sensitive color photographic element generally comprises 1) a blue-sensitive silver halide emulsion layer (or layers) which contains a coupler forming a yellow dye (substantially at a wavelength lower than 500 nm); 2) a green-sensitive silver halide emulsion layer (or layers) which contains a coupler forming a magenta dye (substantially at a wavelength from about 500 to 600 nm); and 3) a red-sensitive silver halide emulsion layer (or layers) which contains a coupler forming a cyan dye (substantially at a wavelength higher than 590 nm). The green and red-sensitive silver halide emulsion layers are made sensitive to the green and red regions of the spectrum by properly associating them with a sensitizer, but they keep their own inherent sensitivity to blue light.

The different silver halide emulsion layers sensitive to the different colors are coated onto a support film, such as a cellulose triacetate (CTA), polyethyleneterephthalate (PET) or a polyethylene naphthalate (PEN) film, where the uppermost layer (or layers) is the blue-sensitive emulsion layer (or layers). To prevent blue light from crossing the blue sensitive layer and exposing the lower sensitive layers which in addition to having been sensitized to particular regions of the spectrum, are also inherently sensitive to blue light, thereby causing false coloring, it is a common practice to coat a layer absorbing blue light between the exposure source and the silver halide emulsion layers used to record green and red light. Such a layer, in the art generally called a yellow filter layer, is commonly coated between the blue-sensitive silver halide emulsion layer (or layers) and all other green and red-sensitive silver halide emulsion layers. The yellow filter layer is useful to absorb blue light during exposure and is usually removed during the photographic material processing.

The yellow filter layer commonly used is a gelatin layer containing dispersed yellow colloidal silver, referred to in the art as Carey Lea silver. The yellow colloidal silver absorbs blue light during exposure and is easily decolored during the bleach and fixing steps of the photographic processing. However, yellow colloidal silver has an undesired absorption in the green region of the spectrum and causes a decrease in the effective sensitivity of the underlying silver halide layers in the material. Moreover, yellow silver may cause an undesired higher photographic fog at the boundary line between the yellow filter layer and the silver halide emulsions layers, such that it may be necessary to coat a barrier layer onto both sides of the yellow filter layer. In addition, the production of dispersed yellow colloidal silver is expensive, requires time and experience.

It has been already proposed to use yellow dyes instead of yellow colloidal silver in the yellow filter layers. Yellow dyes alternative to the yellow colloidal silver have been described for instance in U.S. Pat. Nos. 2,538,008; 2,538,009 and 4,420,555; in GB patents 695,873 and 760,739. Even if many of such dyes have satisfactory absorption characteristics, they are not completely useful as regards non-diffusion, cause residual stain after photographic processing, and incubation stains due to their reaction with other components of the photographic material.

Some patents describe a photographic material which contains a yellow filter dye of the pyrole type substituted in the 2-position thereof. For instance, U.S. Pat. No. 5,298,377 and EP 382,225 describe photographic materials among others containing filter dyes having a nucleus of the pyrole type substituted in the 2-position thereof with a vinylfuranone type nucleus. Such filter dyes are easily decolorized during the photographic processing and do not cause incubation stain, but are not sufficiently resistant to diffusion and cause a sensitivity decrease when they are stored under particular humidity and temperature conditions. U.S. Pat. No. 4,861,700 describes a photographic element containing a yellow filter dye having a tricyanovinyl group in the 2-position and a pyrrole-type group. U.S. Pat. No. 5,776,667 describes a photographic material in the yellow filter layer containing a yellow dye obtained by condensing an isoxazolone nucleus and an aromatic or heteroaromatic aldehyde. The aldehyde nucleus has an oxyethylene group as a substituent. U.S. Pat. No. 4,234,677 describes dye-containing photographic materials: among the many examples of the used dyes, there are described also compounds of the pyrrole type in the 2-position substituted with a vinyl-pyrazolone group.

There are then some patents describing photographic materials which contain pyrrole-type yellow filters having a vinyl group substituted in the 3-position instead of in the 2-position thereof as described in the above-mentioned patents. For example, U.S. Pat. Nos. 5,296,344; 5,449,594; 5,538,836 describe such as filter dye substituted in the 3-position thereof with a vinyl-isoxazolone-type group.

U.S. Pat. Nos. 4,923,788; 6,045,985 and EP 697,758 describe other filter dyes free of the consequences of the colloidal silver and other yellow dyes, such as fog, diffusion and residual stain after processing. In the photographic field there is still the necessity, however, of providing yellow filter dyes satisfying the needs of having a proper absorption, of being quickly and completely decolorized during the photographic processing and of having a good solubility in high-boiling solvents.

SUMMARY OF THE INVENTION

The present invention refers to photographic elements having coated on a support base at least a silver halide emulsion layer sensitized to a radiation different from blue light in addition to the intrinsic or native sensitivity thereof to the blue region or blue radiation, and a yellow filter layer placed between said at least a silver halide emulsion layer and the exposure source, where the filter layer contains a yellow filter dye represented with the formula (1):

formula (1)

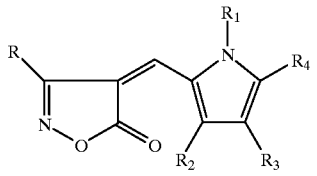

wherein R and $R_1$ each independently represent a hydrogen atom, a substituted or unsubstituted alkyl group, a substituted or unsubstituted alkylene group, a substituted or unsubstituted heterocyclic group or a substituted or unsubstituted aryl group; $R_2$, $R_3$ and $R_4$ each independently represent a hydrogen atom, a substituted or unsubstituted alkyl group, a substituted or unsubstituted aryl group and $R_3$ and $R_4$ may be combined to form a 6-membered ring.

In particular, the present invention relates to multilayer color photographic elements comprising a support having coated thereon in the indicated order starting from the base at least a red-sensitive silver halide emulsion layer, at least a green-sensitive silver halide emulsion layer and at least a blue-sensitive silver halide emulsion layer, respectively associated with non-diffusing color-forming cyan, magenta and yellow couplers, where a yellow filter layer containing a yellow filter dye of the above mentioned formula (1) is placed between said the at least a blue-sensitive emulsion layer and said the at least a green-sensitive emulsion layer.

The photographic elements of the present invention give yellow filter layers containing yellow filter dyes that have the required spectral absorption characteristics, are easily soluble in high-boiling solvents and keep their properties without being easily decolorized in the photographic processings.

DETAILED DESCRIPTION OF THE INVENTION

In formula (1) above, R and $R_1$ independently represent a hydrogen atom, a substituted or unsubstituted alkyl group, a substituted or unsubstituted alkylene group, a substituted or unsubstituted heterocyclic group or a substituted or unsubstituted aryl group. Preferred alkyl groups represented by R and $R_1$ include 1 to 8 carbon atom alkyls comprising linear or branched-chain alkyls, such as methyl, trifluoromethyl, ethyl, propyl, isopropyl, butyl, tert.-butyl and octyl. Preferred alkylene groups represented by R and $R_1$ include 1 to 8 carbon atom alkylenes comprising linear or branched-chain alkylenes, such as ethylene, propylene, isopropylene, butylene, and others. Preferred aryl groups represented by R and $R_1$ include 6 to 10 carbon atom aryls, such as phenyl and naphthyl. Preferred hereocyclic groups represented by R and $R_1$ include 5 or 6-membered heterocyclic groups which may also be fused with other ring systems, such as for example furane, thiophene, pyridine, pyrrole and imidazole. These alkyl, alkylene, hereocycle and aryl groups may be substituted with known substituents. Particularly useful substituents include for instance aryloxy groups (e.g., phenoxy, p-methoxyphenoxy, p-methylphenoxy, naphthyloxy and tolyloxy); acylamino groups (e.g., acetamide, benzamide, butyramide and tert.-butylcarbonamide); sulfonamide groups (e.g., methylsulfonamide, benzenesulfonamide and p-toluylsulfonamide); sulfamoyl groups (e.g., N-methylsulfamoyl, N,N-diethylsulfamoyl and N,N-dimethylsulfamoyl); carbamoyl groups (e.g., N-methylcarbamoyl and N,N-dimethylcarbamoyl); arylsulfonyl groups (e.g., tolylsulfonyl); aryloxycarbonyl groups (e.g., phenoxycarbonyl); alkoxy-carbonyl groups (e.g., alkoxycarbonyl containing from 2 to 10 carbon atoms, such as methoxycarbonyl, ethoxycarbonyl and benzyloxycarbonyl); alkoxy-sulfonyl groups (e.g., alkoxysulfonyl containing from 2 to 10 carbon atoms, such as methoxysulfonyl, octyloxysulfonyl and 2-ethylhexylsulfonyl); aryl-oxysulfonyl groups (e.g., phenoxysulfonyl); alkylureido groups (e.g., N-methylureido, N,N-diemthylureido and N,N-dibutylureido); arylureido groups (e.g., phenylureido); halogen atoms, hydroxy, sulfo, sulfate, carboxyl, amino, alkyl, alkoxy, nitro and cyano groups.

In formula (1) above $R_2$, $R_3$ and $R_4$ each independently represent a hydrogen atom, a substituted or unsubstituted alkyl group or a substituted or unsubstituted aryl group (for a detailed description, see the definitions given for R and $R_1$) and $R_3$ and $R_4$ can combine together to form a 6-membered heterocyclic ring, for instance an indole ring.

Among the yellow filter dyes of formula (1), the particularly preferred ones are those belonging to the following formula (2):

formula (2)

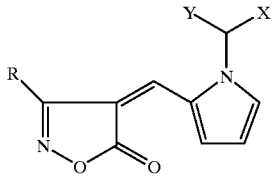

wherein R is as defined in formula (1), X represents a hydrogen atom or a 1 to 6 carbon atom linear or branched-chain alkyl group, and Y represents —COO—$(CH_2$—$CH_2$—$O)_n$—Z or —COO—$(CH(CH_3)$—$CH_2$—$O)_n$—Z, where n=0,1,2 or 3 and Z being a 1 to 4 carbon atom linear or branched-chain alkyl group.

When in the present invention the term "group" is used to define a chemical compound or substituent, the described chemical material comprises the basic group, ring or residue and that group, ring or residue with conventional substitutions. When on the contrary the term "units" is used, only the chemical unsubstituted material is intended to be included. For instance, the term "alkyl group" comprises not only those alkyl units such as methyl, ethyl, butyl, octyl, stearyl, etc., but even those units bearing substituents such as halogen atoms, cyano, oxydryl, nitro, amino, carboxilate groups, etc. The term "alkyl units" on the contrary comprises only methyl, ethyl, stearyl, cyclohexyl, etc.

Specific examples of yellow dyes of formula (1) to be used in the present invention are illustrated hereinbelow, but the present invention is not to be intended as limited thereto.

I-1
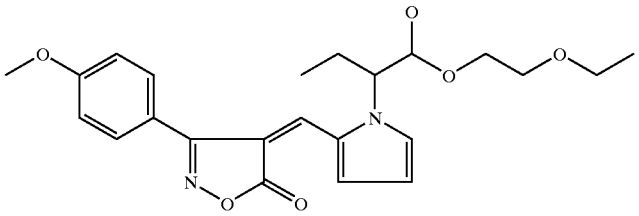
I-2
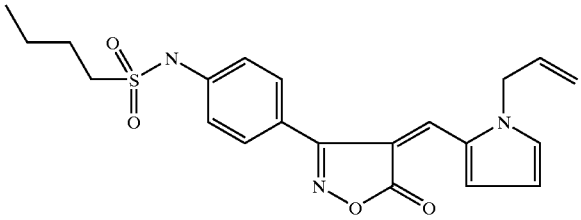
I-3
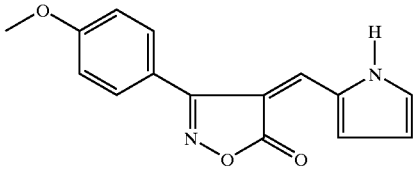
I-4
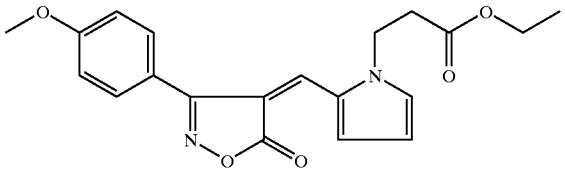
I-5
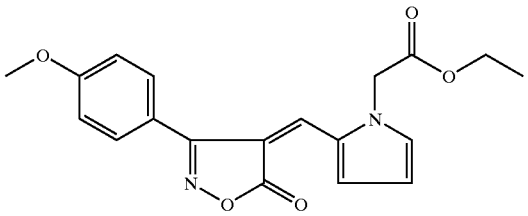
I-6
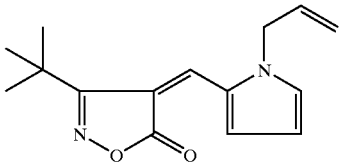
I-7
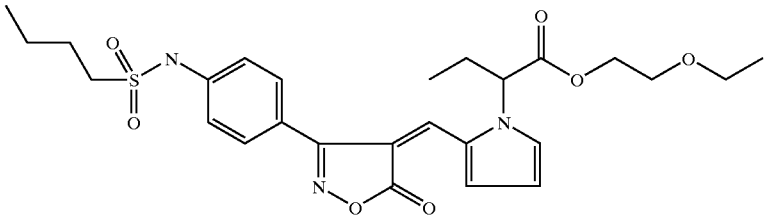
The yellow filter dyes of formula (1) can be prepared according to procedures well-known in the art of organic chemical dyes. The syntheses of the dyes of formula (1) are detailed in the examples.
Synthesis of Compound I-1
A mixture of ethyl-p-anisoylacetate (22 g, 0.1 mole), hydroxylamine chlorohydrate (14 g, 0.2 mole) and ammonium acetate (17 g, 0.22 mole) was heated to reflux in 80 ml methanol for 30 minutes. The reaction mixture was poured into water (500 ml) and the precipitate was collected by filtration, washed with water and dried to give the 3-(4-methoxyphenyl)-isoxazolydin-5-one compound (17.6 g) as a pink-colored solid.

A mixture of α-bromobutyric acid (100 g, 0.6 mole), ethyeneglycolmonoethylether (108 g, 1.2 mole) and p-toluenesulfonic acid (11.4 g, 0.1 mole) was heated at a temperature of 110° C. for 5 hours. The reaction mixture was then poured into water, extracted with ethylacetate and the extracts were dried on sodium sulfate. After solvent evaporation, 105 g of 2-ethoxyethyl α-bromobutyrate were obtained as a yellow-orange oil which was then used in the subsequent step without any further purification.

A mixture consisting of pyrrole-2-carboxaldehyde (9.5 g, 0.1 mole), anhydrous potassium carbonate (27.6 g, 0.2 mole) and 2-ethoxyethyl α-bromobutyrate (23.6 g, 0.105), as previously described, were kept under stirring in 20 ml DMF at room temperature for 12 hours. The reaction mixture was carefully poured into water, extracted with ethylacetate and the extracts were dried on sodium sulfate. After evaporation of the solvent, 15.5 g of 1-[1-(2-ethoxyethoxycarbonyl)-propyl]-2-formyl pyrrole were obtained as a brown oil, which was used in the subsequent step without any further purification.

A mixture formed with 3-(4-methoxyphenyl)-isoxazolidin-5-one (19 g, 0.1 mole), with the previously obtained formylpyrrole derivative (28.1 g, 0.11 mole) and with ammonium acetate (0.8 g, 0.01 mole) was heated at 40° C. in ethanol for 4 hours under stirring. After having cooled the reaction solution, the deposited crystals were filtered to obtain compound I-1 (30.5 g) as an orange-colored solid having a λmax of 420 nm in methanol.

The dye of formula (1) is present in the yellow filter layer in such quantities as to absorb the blue radiation. Typically, the yellow filter layer contains from about 0.1 to 1.0, preferably from about 0.15 to 0.7 grams of yellow dye per square meter. The yellow dye gives an optical density from 0.5 to 3.0, preferably from 0.6 to 2.0 density units measured at the λmax, which typically ranges from 400 to 450, preferably from 410 to 440 nm. However, these quantities and optical densities can be modified such as to fall outside the indicated ranges on the ground of the particular factors, such as a particular photographic element, the position of the yellow filter inside the element and the quantity of blue radiation that is desired to be absorbed by the yellow filter layer.

Methods for incorporating the dye in a binder of the yellow filter layer can vary on the ground of the specific formula and the dye substituents. For instance, if the dye comprises one or more sulfo groups and can move in the binder, it may be useful to use the dye in combination with cathionic polymer mordants, such as those derived from polyvinylpirydine and polyvinylimadazole, aiming at rendering the dye unmovable in the layer.

In a preferred aspect, the filter layer to be used in the present invention comprises the dye incorporated in the binder of the layer under the form of a dispersion of droplets consisting of a water-immiscible solvent where such a dye has been dissolved. According to the dispersion technique, as described for instance in U.S. Pat. No. 2,322,027, the dye is generally dissolved in water-immiscible high-boiling organic solvents (in the art also referred to as permanent solvents, oil-type solvents, and the like) and the resulting organic solution is added to the water composition containing a hydrophilic colloid (gelatin) and a dispersing agent (surfactant). The mixture is then passed through a homogenizing equipment to obtain a dispersion of small droplets (having a mean diameter of less than 1 μm) of the dye-containing organic solvent. In some cases, it may be an advantage to use a more or less water-miscible auxiliary low-boiling organic solvent to make the dye solution easier and to remove then this solvent by evaporation. The resulting dispersion is then mixed with the hydrophilic colloidal composition (gelatin), which is coated to form the yellow filter layer.

Water-immiscible high-boiling organic solvents to disperse yellow filter dyes are well-known in the art, as described for instance in U.S. Pat. Nos. 2,322,027; 2,801,171; 2,835,579; 2,533,514; 3,554,755; 3,748,141; 3,799,765; 4,353,979; 4,430,421 and 4,430,422. Examples of organic solvents include N-butylacetanilide, triphenyl phosphate, dibutylphthalate, tricresylphosphate, N,N-diethyldodecanamide, N,N-dibutyldodecanamide, tris-(2-ethylexyl)-phosphate, acetyltributylcitrate, 2,4-di-tert.-pentylphenol, 2-(2-buthoxyethoxy)-ethylacetate, 1,4-cicloexyldimethylene bis-(2-ethylhexano-ate), bis-(2-ethylhexyl)-phthalate.

Water-immiscible or water-miscible low-boiling auxiliary organic solvents are known in the art, as described for instance in U.S. Pat. Nos. 2,801,170; 2,801,171 and 2,949,360. Examples of useful auxiliary solvents include ethylacetate, carbon tetrachloride, methylethylketone, benzene, ligroin, methanol, ethanol, dimethylsulfoxy, tetrahydrofurane, dioxane and acetone.

The yellow filter layer containing the yellow filter dye (1) can be used in any photographic element where blue light is desired to be absorbed. The yellow filter layer is particularly to advantage in photographic elements having at least a silver halide emulsion layer sensitized to at least a portion of the electromagnetic spectrum different from blue light in addition to the intrinsic sensitivity thereof to blue light. In this case, the yellow filter layer can be used to reduce or prevent light from reaching this silver halide emulsion layer and to assure the response of the silver halide emulsion layer to the radiation it is sensitized to, in addition to blue light.

The yellow filter layer is particularly useful when used in multilayer color photographic elements containing layers sensitive to the red, green and blue regions of the visible spectrum. In such elements, it is preferred that the yellow filter layer be positioned beneath the blue-sensitive layers and above the green and red sensitive layers.

The silver halide color photographic multilayer elements usually comprise, coated on a support base, at least a red-sensitized silver halide emulsion layer associated with cyan dye-forming color couplers, at least a green-sensitized silver halide emulsion layer associated with magenta dye-forming color couplers and at least a blue-sensitized silver halide emulsion layer associated with yellow dye-forming color couplers. Each layer generally consists of multiple (one or more) emulsion sub-layers sensitive to a given region of the visible spectrum. Should the multilayer materials contain multiple blue-, green- and red-sensitive sub-layers, these may be relatively more or less sensitive. These elements further comprise other non-light sensitive layers, such as intermediate, layers, antihalo and protective layers, thus forming a multilayer structure. After having been imagewise exposed to actinic radiation, such color photographic elements are processed with a color developer to give a visible color image. The layer units can be coated in any conventional order, but in a preferred arrangement, the red-sensitive layers are coated nearest the base and the green-sensitive layers, a yellow filter layer and the blue-sensitive layers are coated thereon.

The color photographic elements of the present invention may be conventional photographic elements containing a silver halide as light-sensitive substance.

The silver halides used in the multilayer color photographic elements of this invention may be a fine dispersion (emulsion) of silver chloride, silver bromide, silver chlorobromide, silver iodo-bromide, silver chloro-iodo-bromide grains in a hydrophilic binder. Preferred silver halides are silver iodo-bromide or silver iodo-bromo-chloride containing from 1 to 20%-mol silver iodide. In silver iodo-bromide or iodo-bromo-chloride emulsions, the iodide content may be uniformly distributed among all grains in the emulsion or may vary. The silver halides may have uniform grain sizes or a broader size distribution. The silver halide grains may be regular in shape having a regular crystal structure, such as cubical, octahedrical and tetradecahedrical one, or a spherical or irregular structure of the crystal, or still may be those having crystal defects, such as twin planes or tabular shapes or combinations thereof.

With the term "cubical grains" according to the present invention, substantially cubical grains are intended to be comprised, i.e. cubical regular shaped crystals bounded by crystal faces (100), or grains which may have rounded edges and/or small faces (111), or still grains which may be nearly spherical in shape when prepared in the presence of soluble iodides or strong ripening agents such as ammonia. Particularly good results are obtained with silver halide grains having mean sizes from 0.2 to 3 $\mu$m, more preferably from 0.4 to 1.5 $\mu$m. The preparation of silver halide emulsions comprising silver iodo-bromide grains is described for instance in Research Disclosure, vol. 184, par. 18431; vol. 176, par. 17644 and vol. 308, par. 308119.

Other silver halide emulsions to be used in the present invention are those using one or more light-sensitive tabular grain emulsions. The tabular silver halide grains contained in the emulsion of the present invention have a mean diameter:thickness ratio (in the art often referred to as "aspect ratio") of at least 2:1, preferably from 2:1 to 20:1, more preferably from 3:1 to 14:1 and most preferably from 3:1 to 8:1. The mean diameter of the silver halide grains suitable to be used in the present invention ranges from about 0.3 $\mu$m to about 5 $\mu$m, preferably from 0.5 to 3 $\mu$m, more preferably from 0.8 to 1.5 $\mu$m. The silver halide tabular grains to be used in the present invention have a thickness lower than 0.4 $\mu$m, preferably than 0.3 and more preferably than 0.2 $\mu$m.

The above-described characteristics of the tabular grains may be promptly determined with procedures well-known to the man skilled in the art. With the term "diameter", the diameter of a circle having an area equal to the one projected by the grain is meant. The term "thickness" indicates the distance between two main substantially parallel planes which build-up the silver halide tabular grains. The diameter:thickness ratio of the grain may be calculated by measuring the diameter and the thickness of each grain and the average diameter:thickness ratio by making the average among all tabular grain diameter:thickness ratios. Therefore, the mean diameter:thickness ratio is the average of all mean individual diameter:thickness ratios of the tabular grains. In the practice, it is simpler to obtain mean diameter and thickness of the tabular grains and calculate the average diameter:thickness ratio as the ratio of such two mean values. Whatever may be the method used, the average diameter:thickness ratios obtained do not differ very much one from the other.

In the silver halide emulsion layer containing the tabular silver halide grains, at least 15%, preferably at least 25% and more preferably at least 50% of the grains are tabular grains with a diameter:thickness ratio not lower than 2:1. Each of the above proportions means the proportion of the total projected area of the tabular grains having a diameter:thickness ratio of at least 2:1 and a thickness lower than 0.4 $\mu$m, with respect to the projected area of all silver halide grains in the layer.

It is known that light-sensitive silver halide emulsions can be formed by precipitating the silver halide grains in a water medium comprising a binder, preferably gelatin.

The silver halide grains can be precipitated with a variety of conventional techniques. The silver halide emulsion can be prepared using a single-jet, a double-jet method or combinations thereof or can be ripened by following e.g. an amonia, a neutralization, an acid method or the maturation can be obtained by an accelerated or constant flow speed precipitation, or an interrupted precipitation or still by ultrafiltration during precipitation, etc. References to all these methods may be found in Trivelli & Smith, *The Photographic Journal,* vol. LXXIX, may 1939, pp. 330–338, in T. H. James, *The Theory of The Photographic Process,* $4^{th}$ edition, Chapter 3, in U.S. Pat. Nos. 2,222,264; 3,650,757; 3,917,485; 3,790,387; 3,716,276; 3,979,213; in Research Disclosure, December 1989, par. 308119, "*Photographic Silver halide Emulsions, Preparations, addenda, processing and Systems*" and in Research Disclosure, September 1976, par. 14987.

A common technique is the batch process, commonly referred to as double jet precipitation, where a silver salt water solution and a halide salt water solution are at the same time added into a vessel containing the dispersing medium.

In the double-jet method, where the alkaline halide and the silver nitrate solutions are at the same time added into the gelatin solution, the silver halide grains shape and size can be kept under control with the type and concentration of the solvent present in the gelatin solution and with the addition velocity. Double-jet processes are for instance described in GB patents 1,027,146 and 1,302,405 and U.S. Pat. Nos. 3,801,326; 4,046,376; 3,790,386; 3,897,935; 4,147,551 and 4,171,224.

The single-jet method, where a silver nitrate solution is added to a halide and gelatin solution, has been used for a long time in the manufacture of photographic emulsions. In this method, since the variation of the halide concentration in the solution determines which silver halide grains are formed, such halides are a mixture of different shape and size halides.

The silver halide grain precipitation usually occurs in two distinct stages. In a first one, nucleation, the silver halide grain is formed. This stage is followed by a second one, the growth, where additional silver halide which formed as a reaction product precipitates onto the silver halide grains formed beforehand thus allowing them to grow. The double-jet batch precipitation process is typically carried out under quick stirring of the reactants, where the volume inside the reaction vessel continuously increases during the silver halide precipitation and soluble salts are additionally formed further to the silver halide grains.

In order to avoid that soluble salts in the emulsion layers of a photographic material crystallize once that coating has been performed and also to avoid other photographic or mechanical drawbacks (viscosity, brittleness, etc.), the soluble salts formed during precipitation shall be removed.

While preparing the silver halide emulsions to be used in the present invention, a large variety of hydrophilic dispersing agents for the silver halides may be used. As a hydrophilic dispersing agent, any hydrophilic polymer conventionally used in photography may be used to advantage, such as gelatin, gelatin derivatives, such as acylated gelatin, graft gelatin, etc., albumin, gum arabic, agar agar, cellulose derivative, such as hydroxyethylcellulose, carboxymethylcellulose, etc., a synthetic resin, such as polyvinyl alcohol, polyvinylpyrrolidone, polyacrylamide, etc. Other useful hydrophilic materials known in the art are described for instance in Research Disclosure, vol. 308, par. 308119, item IX.

The silver halide grain emulsion to be used in the present invention can be chemically sensitized using sensitizing agents known in the art. Particular useful compounds are those that contain sulfur, gold and noble metal compounds and poloxyalkylene compounds. In particular, the silver halide emulsions can be chemically sensitized with a sulfur sensitizer, such as sodium thiosulfate, allylthiocyanate, allylthiourea, thiosulfinic acid and the sodium salt thereof, sulfonic acid and the sodium salt thereof, allylthiocarbamide, thiourea, cystine, etc.; an active or inert selenium sensitizer; a reducing sensitizer such as stannous salt, polyamine, etc.; a noble metal sensitizer, such as gold or, more precisely, potassium aurithiocyanate, potassium chloroaurate, etc.; or a water soluble salt sensitizer, such as for instance rhutenium, rhodium, iridium and the line and, more precisely, ammonium chloropalladate, potassium chloroplatinate and sodium chloropalladite, etc.; whereby each can be used alone or in proper combinations. Other examples of useful chemical sensitizers are for instance described in Research Disclosure 17643, III, 1978 and in Research Disclosure 308119, III, 1989.

The silver halide emulsion to be used in the present invention can be spectrally sensitized with the dyes of many classes, comprising the polymethyne dye class which includes cyanines, merocyanines, complexed cyanines and merocyanines, oxonols, hemioxonols, stiryls, merostiryls and streptocyanines.

The cyanine spectral sensitizer dyes comprise, linked together with a methine bridge, two basic heterocyclic nuclei such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellur-azole, oxotellurazole.

The merocyanine spectral sensitizer dyes comprise, linked together with a methine bridge, a basic heterocyclic nucleus of the cyanine dye type and an acid nucleus which may be derived from barbituric acid, 2-thiobarbituric acid, rhodanine, indantoine, 2-thioidantoine, 2-pyrazolin-5-one, 2-isoxazolin-5-one, indan-1,3-dione, cyclohexan-1,3-dione, 1,3-dioxan-4,6-dione, pyrazolin-3,5-dione, pentan-2,4-dione, alkylsulfonylacetonitrile, malononitrile, isoquinolin-4-one, chroman-2,4-dione, and the like.

One or more spectral sensitizer dyes can be used. In the art there are known dyes which have sensitization maxima covering all visible and infrared spectrum wavelengths and a large variety in the shape of their spectral sensitization curves. The choice and the proportions depend upon the region the sensitization is desired to and upon the spectral sensitivity curve which is desired.

Examples of sensitizer dyes can be found in Venkataraman, "*The Chemistry Of Synthetic Dyes*", Academic Press, new York, 1971, chapter V, in James "*The Theory Of The Photographic Process*", 4$^{th}$ edition, McMillan 1977, chapter b, in F. M. Hamer, "*Cyanine Dyes And Related Compounds*", John Wiley & Sons, 1964 and in Research Disclosure 308119, III, 1989.

The silver halide emulsions to be used in the present invention may contain optical brighteners, antifogging agents and stabilizers, filter and antihalo dyes, hardeners, coating aids, plasticizers and lubricants and other auxiliary substances, as described for instance in Research Disclosure 17643, V, VI, VIII, X, XI and XII, 1978 and in Research Disclosure 308119, V, VI, VIII, X, XI and XII, 1989.

The silver halide emulsions to be used in the present invention can be used to produce light-sensitive silver halide multilayer color photographic elements, such as color negative photographic elements, color reversal photographic elements, color positive photographic elements, false color photographic elements (like those described in U.S. Pat. No. 4,619,829), and the like, the preferred one of which are color negative photographic elements.

Suitable color couplers are preferably selected among the couplers having groups preventing the diffusion thereof, such as groups having hydrophobic organic residues of about 8–32 carbon atoms, introduced into the molecule of the coupler itself in a position from which they cannot be released. Such as residue is called "ballasting group". The ballasting group is linked to the coupler nucleus either directly or through an imino, ether, carbonamido, sulfonamido, ureido, ester, imido, carbamoyl, sulfamoyl group. Examples of ballasting groups are described in U.S. Pat. No. 3,892,572.

Such non-diffusing couplers are introduced into the light-sensitive silver halide emulsion layers or into non light-sensitive layers adjacent thereto. Upon exposure and color development, such couplers give a color which is complementary to the light color the silver halide emulsion layers are sensitive to. Consequently, to the red-sensitive silver halide emulsion layers there is associated at least a cyan image-forming non-diffusing color coupler, generally a phenole or α-naphthole compound; to the green-sensitive silver halide emulsion layers there is associated at least a magenta image-forming non-diffusing color coupler, generally a 5-pyrazolone or pyrazolotriazole compound; and to the blue-sensitive silver halide emulsion layers there is associated at least a yellow image-forming non diffusing color coupler, generally an acylacetanilide compound.

Such color couplers can be 4- or 2-equivalent compounds, the latter requiring a smaller quantity of silver halide to produce color. As well-known, 2-equivalent couplers derive from 4-equivalent couplers since in the coupling position thereof they contain a substituent which is released during the coupling reaction. 2-Equivalent couplers which can be used in the silver halide color photographic elements comprise both those which are substantially colorless and those which are colored ("masked couplers"). 2-Equivalent couplers also comprise leuco couplers which, upon reaction with the oxidation products of the color developer, do not produce any color. 2-Equivalent color couplers also comprise DIR couplers which, upon reaction with the oxidation products of the color developer, are capable of releasing a development-inhibiting diffusing compound.

The most useful cyan-forming couplers are conventional phenole and α-naphthole compounds. Examples of cyan couplers can be selected among those described in U.S. Pat. Nos. 2,369,929; 2,474,293; 3,591,383; 2,895,826; 3,458,315; 3,311,476; 3,419,390; 3,476,563 and 3,253,924; in GB patent 1,201,110 and in Research Disclosure 308119, VII, 1989.

The most useful magenta-forming couplers are conventional pyrazolone, indazolone, cyanoacethyle, pyrazolotriazole, etc. type compounds and particularly preferred couplers are the ones of the pyrazolone type. Magenta-forming couplers are described for instance in U.S. Pat. Nos. 2,600,788; 2,983,608; 3,062,653; 3,127,269; 3,311,476; 3,419,391; 3,519,429; 3,558,319; 3,582,322; 3,615,506; 3,834,908 and 3,891,445; in DE patent 1,810,464; in DE patent applications 2,408,665; 2,417,945; 2,418,959 and 2,424,467; in JP patent applications 20826/76; 58922/77; 129538/74; 74027/74; 159336/75; 42121/77; 60233/75; 26541/76 and 55122/78; and in Research Disclosure 308119, VII, 1989.

The most useful yellow-forming couplers that can be used in combination with the yellow-dye forming couplers previously described are conventional open-chain ketomethylene type couplers. Particular examples thereof are benzoylacetanilide and pivaloylacetanilide type compounds. Yellow forming couplers which can be used are specifically described in U.S. Pat. Nos. 2,875,057; 3,235,924; 3,265,506; 3,278,658; 3,369,859; 3,408,194; 3,415,652; 3,528,322; 3,551,151; 3,682,322; 3,725,072 and 3,891,445; DE patents 2,219,917; 2,261,361 and 2,414,006; GB patent 1,425,020; JP patent 10783/76; in JP patent applications 26133/72; 73147/73; 102636/76; 6341/75; 123342/75; 130442/75; 1827/76; 87650/75; 82424/77 and 115219/77; and in Research Disclosure 308119, VII, 1989.

There may be used colored couplers which comprise those described for instance in U.S. Pat. Nos. 3,476,560 and 3,034,892; in JP published patents 2016/69; 22335/63; 11304/67 and 32461/69; in JP patent applications 26034/76 and 42121/77; and in DE patent application 2,418,959. The light-sensitive silver halide color photographic element may contain high molecular weight color couplers, as described for instance in U.S. Pat. No. 4,080,211; in EP patent application 27,284 and in DE patents 1,297,417; 2,407,569; 3,148,125; 3,217,200; 3,320,079; 3,324,932; 3,331,743 and 3,340,376 and in Research Disclosure 308119, VII, 1989.

Cyan colored couplers may be selected among those described in U.S. Pat. Nos. 3,934,802; 3,386,301 and 2,434,272; magenta colored couplers among the ones described in U.S. Pat. Nos. 2,434,272; 3,476,564 and 3,476,560 and GB Patent 1,464,361. Colorless couplers may be selected among those described in GB Patents 861,138; 914,145 and 1,109,963; U.S. Pat. No. 3,580,722 and in Research Disclosure 308119, VII, 1989.

Together with the above-mentioned couplers there may be used also couplers which shall give diffusing colored dyes to improve image graininess. Specifical examples are the magenta couplers described in U.S. Pat. No. 4,366,237; GB Patent 2,125,570, and the yellow, magenta and cyan couplers described in EP Patent 96,873; DE Patent 3,324,533 and in Research Disclosure 308119, VII, 1989.

Among 2-equivalent couplers there are also those couplers which in the coupling position thereof bear a group which is released during color development reaction to yield a given photographic activity, e.g. as development inhibitor or accelerator, either directly or after removal one or other groups from the group originally released. Examples of such 2-equivalent couplers comprise the known DIR couplers, and DAR, FAR and BAR couplers, as well. Typical examples of such couplers are described in DE patent applications 2,703,145; 2,855,697; 3,105,026; 3,319,428; 1,800,420; 2,015,867; 2,414,006; 2,842,063; 3,427,235; 3,209,110 and 1,547,640; in GB patents 953,454 and 1,591,641; in EP patent applications 89,843; 117,511; 118,087; 193,389 and 301,477 and in Research Disclosure 308119, VII, 1989.

Examples of non color-forming DIR couplers which may be used in the silver halide color elements comprise those described in U.S. Pat. Nos. 3,938,996; 3,632,345; 3,639,417; 3,297,445 and 3,928,041; in DE patent applications 2,405,442; 2,523,705; 2,460,202; 2,529,350 and 2,448,063; in JP applications 143538/75 and 147716/75; in GB Patents 1,423,588; 1,542,705 and 301,477; and in Research Disclosure 308119, VII, 1989.

The couplers can be introduced into the silver halide emulsion layers by applying some conventional methods known to the man skilled in the art. According to U.S. Pat. Nos. 2,322,027; 2,801,170; 2,801,171 and 2,991,177, the couplers can be incorporated into the silver halide emulsion layer with the dispersion technique, which consists in dissolving the coupler in a high-boiling water-immiscible organic solvent and then dispersing the obtained solution in a colloidal hydrophilic binder as very small droplets. The preferred colloidal binder is gelatin, even if other binders may also be used.

Another method for introducing the couplers into the silver halide emulsion layer is the so-called "loaded latex technique". A detailed description of such a technique can be found in BE Patents 853,512 and 869,816; U.S. Pat. Nos. 4,214,047 and 4,199,363 and EP Patent 14,921. It consists of mixing a coupler solution in a water-mixable organic solvent with a polymeric latex consisting of water as a continuous phase and polymer particles having a mean diameter of 0.02 to 0.2 $\mu$m as a dispersed phase.

Another useful method is further the Fisher process, according to which couplers having a water-soluble group such as a carboxyl, hydroxy, sulfonic or sulfonamido group can be added to the photographic layer for instance by dissolving them in an alkaline water solution.

Useful methods for introducing the couplers into the silver halide emulsions are described in Research Disclosure 308119, VII, 1989.

The layers of the photographic elements can be coated on various support bases, such as cellulose ester (e.g., cellulose triacetate), paper, polyester films (e.g., polyethylene terephthalate or naphthalate), and the like, as described in Research Disclosure 308119, XVII, 1989.

The photographic elements according to the present invention, after having been exposed, can be processed to form a visible image by associating the silver halides thereof with a water medium in the presence of a developer agent contained either in the medium or in the material, as known in the art. The primary aromatic amine color developer agent, used in the photographic developer composition, may be any known compound within the class of the p-phenylene diamine derivatives, widely employed in many color photographic processings. Particularly useful color developer agents are the p-phenylene diamine derivatives, i.e. the N,N-dialkyl-p-phenylene diamine derivatives where the alkyl groups or the aromatic nucleus can be substituted or not substituted.

Examples of p-phenylene diamine developers comprise the salts of: N,N-diethyl-p-phenylene diamine, 2-amino-5-diethylamino-toluene, 4-amino-N-ethyl-N-(α-methansulfonamidoethyl)-m-toluidine, 4-amino-3-methyl-N-ethyl-N-(α-hydroxyethyl)-aniline, 4-amino-3-(α-methylsulfonamidoethyl)-N,N-diethyl-aniline, 4-amino-N,N-diethyl -3-(N'-methyl-α-methylsulfonamido)-aniline, N-ethyl-N-methoxy-ethyl-3-methyl-p-phenylene diamine, and the like, as described e.g. in U.S. Pat. Nos. 2,552,241; 2,556,271; 3,656,950 and 3,658,525.

Examples of commonly used developer agents of the p-phenylene diamine salt type are: 2-amino-5-diethylaminotoluene chlorohydrate (generally known as CD2 and used in the developing solutions for color positive photographic materials), 4-amino-N-ethyl(α-methansulfonamidoethyl)-m-toluidine sesquisulfate monohydrate (generally known as CD3 and used in the developing solutions for photographic paper and color reversal materials) and 4-amino-3-methyl-N-ethyl-N-(β-hydroxyethyl)aniline sulfate (in general known as CD4 and used in the developing solutions for color negative photographic materials).

The color developer agents in general are used in a quantity ranging from about 0.001 to about 0.1 mole per liter, preferably from about 0.0045 to about 0.04 mole per liter of the color photographic developer compositions.

In the case of color photographic materials, the processing comprises at least a color developing bath and possibly a prehardening bath, a neutralizing bath, a first (black and white) developing bath, etc. All these baths are well-known in the art and are for instance described in Research Disclosure 17643, 1978 and 308119, XIX and XX, 1989.

After color development, the image-wise developed metallic silver and the remaining silver salts shall be removed from the photographic element. This is done either in separate bleach and fixing baths or in a single bath, called blix bath, which bleaches and fixes the image in a single step. The bleaching bath is a water solution having a pH equal to 5.60 and containing an oxidizing agent, generally an alkaline metal or ammonium and trivalent iron complex salt with an organic acid, e.g. EDTA.Fe.$NH_4$, where EDTA is ethylenediaminotetracetic acid, or PDTA.Fe.$NH_4$, where PDTA is propylenediaminotetracetic acid. During processing, this bath is continuously aired to oxidize the divalent iron which forms during bleaching the silver image and regenerated, as known in the art, to keep its affects safe. The bad working of these operations may cause the disadvantage of losing the cyan density of the dyes.

In addition to the above mentioned oxidizing agents, the blix bath can contain known fixing agents, such as e.g. ammonium or alkaline metal thiosulfates. Both bleaching and fixing baths may contain other additions, e.g. polyalkyleneoxide compounds, as described e.g. in GB Patent 933, 008, to improve the bath effectiveness, or thioether compounds known as bleach accelerators.

The present invention will be now illustrated by reference to the following unlimiting examples.

EXAMPLE 1

The methanol solutions (samples 1 to 15) of the dyes reported in table 1 were prepared so as to have a density value of 0.6 in correspondence to the λmax value for each compound. Table 1 also reports the maximum absorption values and the density values measured at 400, 450 and 500 nm.

TABLE 1

| Samples | Compounds | $\lambda_{max}$ (nm) | $D_{400}$ | $D_{450}$ | $D_{500}$ |
|---|---|---|---|---|---|
| 1 (invention) | I-1 | 420 | 0.48 | 0.28 | 0.00 |
| 2 (invention) | I-2 | 421 | 0.41 | 0.24 | 0.00 |
| 3 (invention) | I-3 | 418 | 0.48 | 0.08 | 0.00 |
| 4 (invention) | I-4 | 420 | 0.44 | 0.22 | 0.00 |
| 5 (invention) | I-5 | 419 | 0.47 | 0.21 | 0.00 |
| 6 (invention) | I-6 | 415 | 0.52 | 0.17 | 0.00 |
| 7 (invention) | I-7 | 423 | 0.42 | 0.03 | 0.00 |

TABLE 1-continued

| Samples | Compounds | $\lambda_{max}$ (nm) | $D_{400}$ | $D_{450}$ | $D_{500}$ |
|---|---|---|---|---|---|
| 8 (comparison) | Argento Carey Lea | 423 | 0.40 | 0.40 | 0.10 |
| 9 (comparison) | A | 481 | 0.02 | 0.35 | 0.35 |
| 10 (comparison) | B | 463 | 0.09 | 0.53 | 0.10 |
| 11 (comparison) | C | 377 | 0.45 | 0.03 | 0.00 |
| 12 (comparison) | D | 374 | 0.35 | 0.00 | 0.00 |
| 13 (comparison) | E | 437 | 0.26 | 0.50 | 0.00 |
| 14 (comparison) | F | 437 | 0.28 | 0.54 | 0.00 |
| 15 (comparison) | G | 438 | 0.27 | 0.55 | 0.00 |

The data reported in Table 1, with which it is possible to plot the absorption curve of the dyes under examination, show that Samples from 1 to 7 of the present invention, like comparison Samples 13 to 15, contain compounds with spectral characteristics such as to absorb primarily blue light (400–500 nm) without having an undesired absorption in the green region (500–600 nm). The same data show that colloidal silver too (contained in comparison Sample 8) and Compounds A and B (contained in comparison Samples 9 and 10) mainly absorb in the blue region, but that the green region (500–600 nm) is also interested, thus causing a loss of the magenta sensitivity. On the contrary, comparison Samples 11 and 12 contain compounds that mainly absorb in the ultraviolet.

Compound A

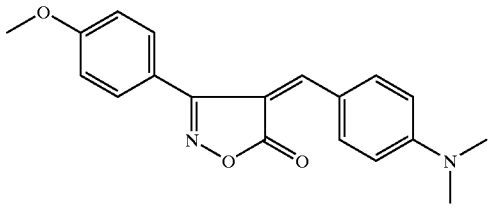

Compound B

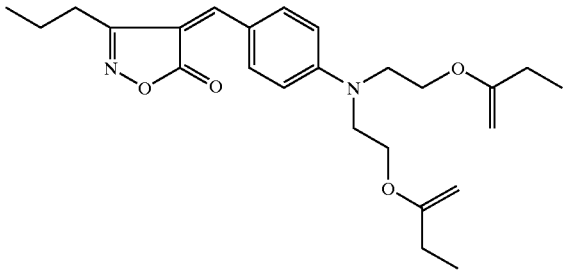

Compound C

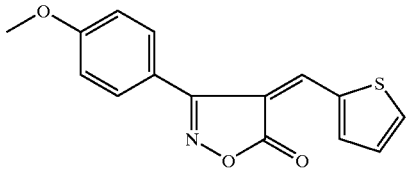

-continued

Compound D

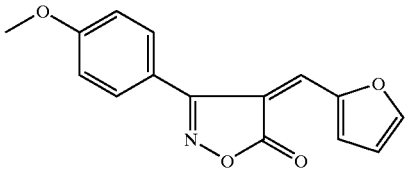

Compound E

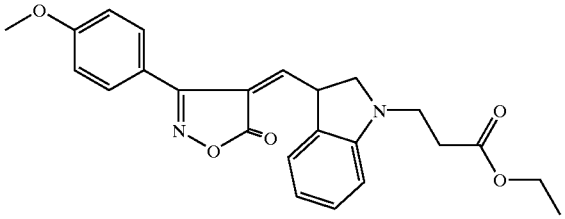

described in U.S. Pat. No. 5,296,344

Compound F

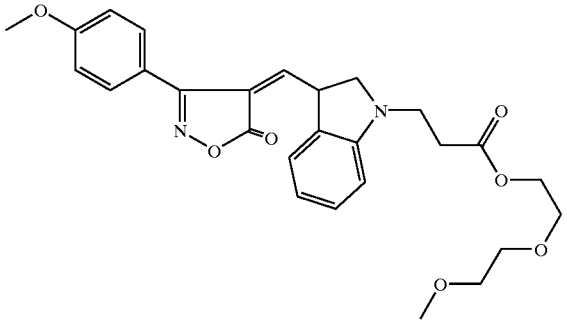

Compound G

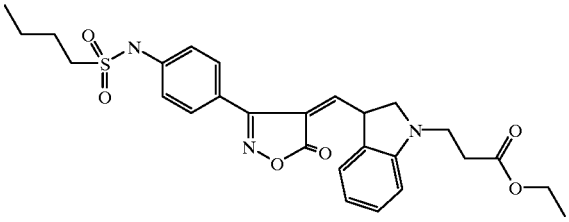

described in U.S. Pat. No. 5,296,344

EXAMPLE 2

The compounds shown in Table 2 were added with a quantity of tricresylphosphate under stirring at 60° C. up to obtain a limpid solution. The samples were then cooled at room temperature and the crystallization tendency thereof was evaluated. The solubility data are reported in Table 2.

TABLE 2

| Samples | Compounds | Solubility | Not-to-Crystallize Tendency |
|---|---|---|---|
| 1 (invention) | I-1 | good | good |
| 7 (invention) | I-7 | good | good |
| 9 (comparison) | A | not soluble | — |
| 13 (comparison) | E | good | not good |

TABLE 2-continued

| Samples | Compounds | Solubility | Not-to-Crystallize Tendency |
|---|---|---|---|
| 14 (comparison) | F | good | not good |
| 15 (comparison) | G | good | not good |

Table 2 shows that Samples 1 and 7 of the present invention have a good solubility and do not exhibit any tendency to crystallize when cooled at room temperature, instead of an insolubility shown by comparison sample 9 and a tendency to crystallize of reference samples 13–15. This allows the dye to be easily introduced by dispersion into the photographic material.

EXAMPLE 3

A silver halide multilayer color photographic material A (reference) was prepared by coating a gelatin-subbed cellulose triacetate base with the following layers in the indicated order. In the following compositions, the quantity of gelatin and of the other components are indicated in grams per square meter ($g/m^2$); the quantity of the emulsions and of colloidal silver are expressed in g of $Ag/m^2$. All silver halide emulsions are stabilized with 4-hydroxy-6-methyl-1,3,3a,7-tetrazaindene and spectrally sensitized with the proper red, green or blue spectral sensitizer dyes.

| | |
|---|---|
| Layer 1 (Antihalo Layer) | |
| Black colloidal silver | 0.106 |
| Gelatin | 0.940 |
| Dye 1 | 0.004 |
| UV-1 | 0.062 |
| UV-2 | 0.062 |
| Solvent 1 | 0.110 |
| Solvent 2 | 0.006 |
| Solvent 3 | 0.008 |
| Layer 2 (Antihalo Layer) | |
| Black colloidal silver | 0.080 |
| Gelatin | 1.160 |
| Dye 2 | 0.003 |
| Dye 1 | 0.005 |
| UV-1 | 0.124 |
| UV-2 | 0.062 |
| Solvent 2 | 0.005 |
| Solvent 3 | 0.010 |
| Layer 3 (Interlayer) | |
| Gelatin | 1.000 |
| Compound 1 | 0.002 6 |
| UV-1 | 0.049 |
| UV-2 | 0.049 |
| Solvent 1 | 0.078 |
| Layer 4 (First Less Red-Sensitive Layer) | |
| Silver iodobromide emulsion (AgI 2.5-% mole, mean diameter 0.22 μm) | 0.730 |
| Gelatin | 1.290 |
| Cyan dye forming coupler C-1 | 0.320 |
| Cyan masked coupler CM-1 | 0.040 |
| Dye 2 | 0.004 |
| Dye 3 | 0.019 |
| Solvent 1 | 0.168 |
| Solvent 4 | 0.223 |

-continued

| | |
|---|---|
| Layer 5 (Second Less Red-Sensitive Layer) | |
| Silver iodobromide emulsion (Agl 6-% mole, mean diameter 0.60 μm) | 0.970 |
| Gelatin | 1.126 |
| Cyan dye forming coupler C-1 | 0.409 |
| DIR coupler D-1 | 0.008 |
| Cyan masked coupler CM-1 | 0.061 |
| Solvent 1 | 0.157 |
| Solvent 4 | 0.295 |
| Layer 6 (Third More Red-Sensitive Layer) | |
| Silver iodobromide emulsion (Ag1 12-% mole, mean diameter 1.10 μm) | 0.600 |
| Gelatin | 0.680 |
| Cyan dye forming coupler C-1 | 0.133 |
| DIR coupler D-2 | 0.001 |
| Cyan masked coupler CM-1 | 0.048 |
| Solvent 1 | 0.046 |
| Solvent 4 | 0.092 |
| Layer 7 (Interlayer) | |
| Gelatin | 1.300 |
| Compound 1 | 0.064 |
| Solvent 2 | 0.081 |
| Hardener H-1 | 0.081 |
| Layer 8 (First Less Green-Sensitive Emulsion Layer) | |
| Silver iodobromide emulsion (Agl 2.5-% mole, mean diameter 0.22 μm) | 0.355 |
| Gelatin | 1.460 |
| magenta dye forming coupler M-1 | 0.328 |
| Magenta masked coupler MM-1 | 0.061 |
| Dye 2 | 0.003 |
| Compound 1 | 0.007 |
| Solvent 2 | 0.180 |
| Solvent 3 | 0.136 |
| Layer 9 (Second Less Green-Sensitive Emulsion Layer) | |
| Silver iodobromide emulsion (Agl 6-% mole, mean diameter 0.60 μm) | 0.410 |
| Gelatin | 0.850 |
| Magenta dye forming coupler M-1 | 0.074 |
| DIR coupler D-1 | 0.005 |
| Magenta masked coupler MM-1 | 0.049 |
| Compound 1 | 0.007 |
| Solvent 1 | 0.009 |
| Solvent 2 | 0.047 |
| Solvent 3 | 0.107 |
| Layer 10 (Third more green-sensitive emulsion layer) | |
| Silver iodobromide emulsion (Al 12-% mole, mean diameter 1.10 μm) | 0.600 |
| Gelatin | 0.840 |
| Magenta dye forming coupler M-1 | 0.092 |
| DIR coupler D-2 | 0.007 |
| Magenta masked coupler MM-1 | 0.008 |
| Compound-1 | 0.009 |
| Solvent 2 | 0.060 |
| Solvent 3 | 0.018 |
| Layer 11 (Interlayer) | |
| Gelatin | 1.000 |
| Dye 1 | 0.004 |
| Solvent 2 | 0.060 |
| Layer 12 (Yellow filter layer) | |
| Yellow colloidal silver | 0.040 |
| Gelatin | 0.840 |
| Hardener H-1 | 0.058 |
| Hardener H-2 | 0.016 |
| Layer 13 (First less blue-sensitive emulsion layer) | |
| Silver iodobromide emulsion (Agl 2.5-% mole, mean diameter 0.22 μm) | 0.095 |
| Silver iodobromide emulsion (Agl 6-% mole, mean diameter 0.60 μm) | 0.285 |
| Gelatin | 1.090 |
| Yellow dye forming coupler Y-1 | 0.694 |

-continued

| | |
|---|---|
| DIR coupler D-1 | 0.039 |
| Solvent 1 | 0.231 |
| Solvent 2 | 0.004 |
| Solvent 5 | 0.231 |
| Dye 1 | 0.004 |
| Layer 14 (Second less blue-sensitive emulsion layer) | |
| Silver iodobromide emulsion (Agl 12-% mole, mean diameter 1.10 μm) | 0.740 |
| Gelatin | 1.430 |
| Yellow dye forming coupler Y-1 | 0.308 |
| DIR coupler D-1 | 0.026 |
| Cyan dye forming coupler C-2 | 0.016 |
| Solvent 1 | 0.103 |
| Solvent 5 | 0.103 |
| Layer 15 (First protective layer) | |
| Non-sensitive silver bromide Lippmann emulsion | 0.174 |
| Gelatin | 1.130 |
| UV-1 | 0.097 |
| UV-2 | 0.097 |
| Solvent 1 | 0.213 |
| Compound 2 | 0.133 |
| Layer 16 (Second protective layer) | |
| Gelatin | 0.089 |
| Polymethylmethacrylate matting particles | 0.013 |
| Ethylmethacrylate-methacrylic acid matting particles | 0.180 |
| Hardener H-1 | 0.325 |

Film B (invention) was prepared like Film A , but in the $12^{th}$ layer the yellow colloidal silver had been replaced with the yellow filter dye I-1 of the present invention, in the presence of tricresylphosphate, such as to obtain the same optical density in blue light.

Samples of Films A and B were exposed to a white light source having a color temperature of 5,500° K. and afterwards developed in a standard C41-type processing, as described in *British Journal of Photography,* Jul. 12, 1974, pp. 597–598. The following Table 3 reports the sensitometrical results comprising fog values (Dmin), maximum optical density (Dmax), logE sensitivity at density 0.2 above Dmin (Sensit. 1) and logE sensitivity at density 1.0 above Dmin (Sensit. 2) of the blue-sensitive layers (G) and of the green-sensitive layers (M), which are the most interesting values to see if there is a good protection against blue light by a yellow filter-containing layer.

TABLE 3

| Film | Yellow Filter | Layer | Dmin | Dma | x | Sensit. 1 | Sensit. 2 |
|---|---|---|---|---|---|---|---|
| A | Colloidal | G | 0.78 | 2.24 | 1.62 | 0.60 |
| (reference) | silver | M | 0.58 | 2.69 | 1.60 | 0.59 |
| B | Compound | G | 0.71 | 2.30 | 1.66 | 0.70 |
| (invention) | I-1 | M | 0.56 | 2.74 | 1.74 | 0.74 |

Table 3 shows that Film B of the present invention containing, Compound I-1 as a yellow filter, both in the blue light sensitive layers (G) and in the green light sensitive layers (M) exhibits a sensitive decrease of fog formation and a drastic improvement of the maximum optical density and of both sensitivities, with respect to the reference Film A, which does not have such yellow filter compound.

Hereinbelow there are reported the formulas of the compounds used in the pres??ent invention.

Dye 1:
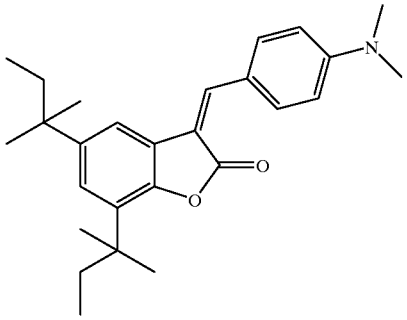
Dye 2:
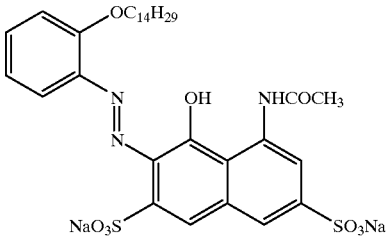
Dye 3:
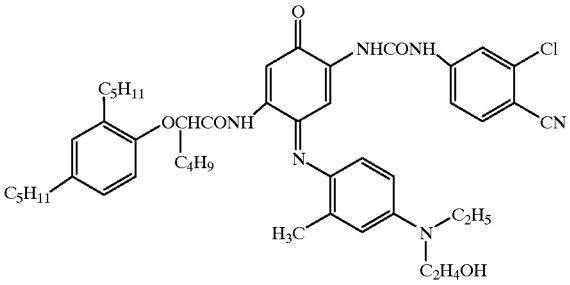
Compound 1:
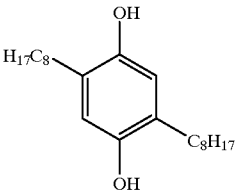
Compound 2:
$(—CH_2NHCONH_2)_2$
-continued
UV-1:
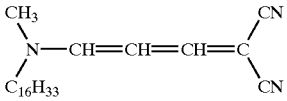
UV-2:
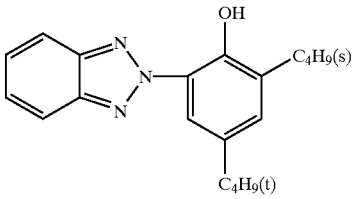
Cyan dye forming coupler C-1:
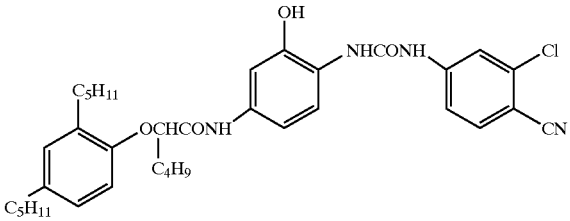
Cyan dye forming coupler C-2
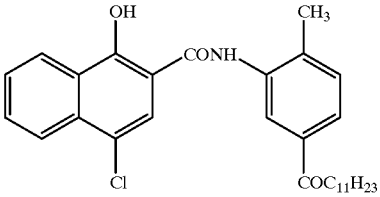
Cyan masked coupler CM-1:
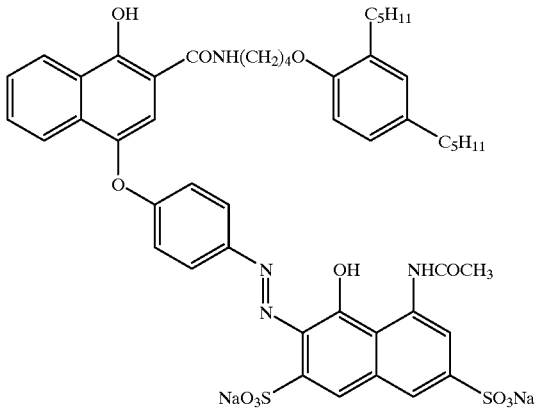

DIR coupler D-1:

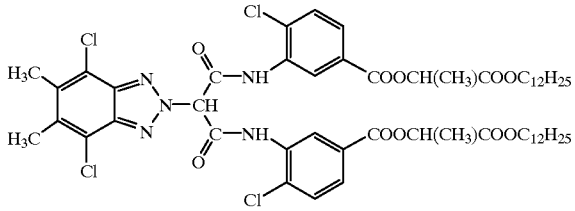

Solvent 1: N-Butylacetanilide
Solvent 2: Tricresylphosphate
Solvent 3: Diethyllauramide
Solvent 4: Dibutylphthalate
Solvent 5: Bis-(2-ethylhexyl)-phosphate Hadener H-1:

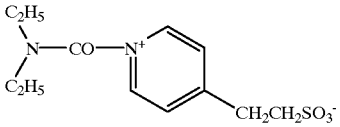

Hardener H-2:

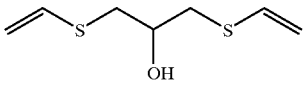

Magenta dye forming coupler M-1:

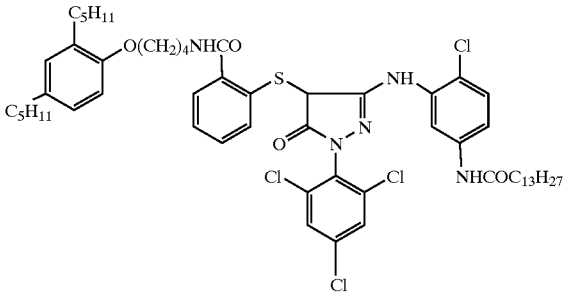

DIR coupler D-2:

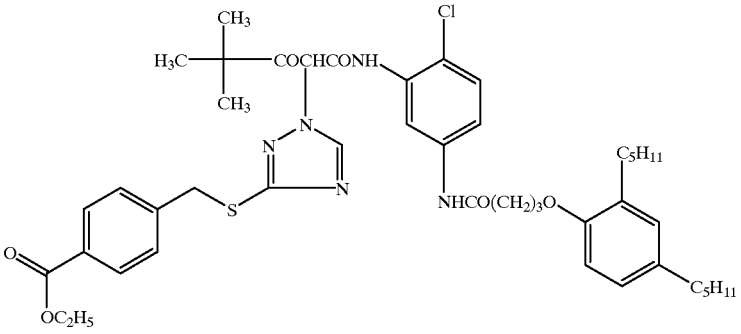

Magenta masked coupler MM-1:

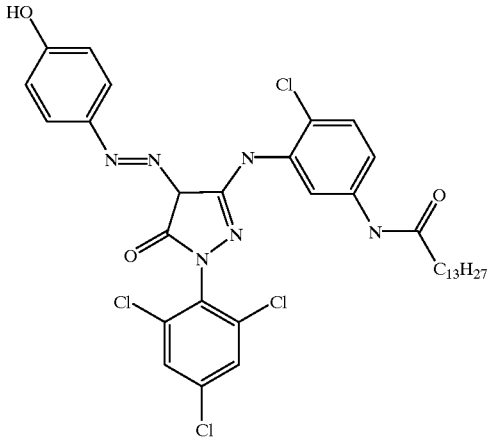

Yellow coupler Y-1:

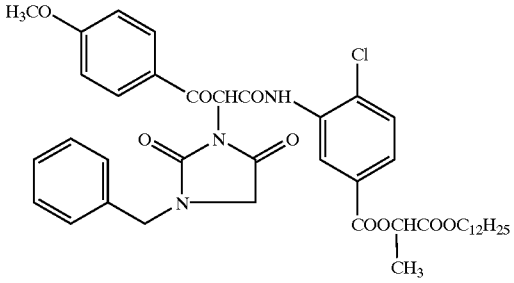

What is claimed is:

1. Photographic elements having coated on a support base at least a silver halide emulsion layer sensitized to a radiation different from blue light in addition to its intrinsic sensitivity to blue light, and a yellow filter layer coated between said at least a silver halide emulsion layer and the exposure source, where said yellow filter layer contains yellow filter dye represented by formula (1):

(1)

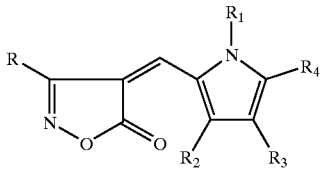

wherein R and $R_1$ each independently represent a hydrogen atom, an alkyl group, an alkylene group, a heterocyclic group or an aryl group; $R_2$, $R_3$ and $R_4$ each independently represent a hydrogen atom, an alkyl group, or an aryl group and $R_3$ and $R_4$ may be combined to form a 6-membered ring.

2. The photographic elements of claim 1, where the yellow filter dye is represented by the formula:

(2)

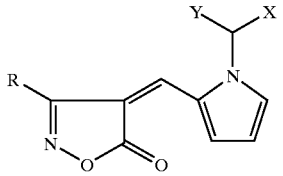

wherein R represents a hydrogen atom, an alkyl group , a heterocyclic group or an aryl group, X represents a hydrogen atom or a 1 to 6 carbon atom alkyl group, and Y represents —COO—$(CH_2—CH_2—O)_n$—Z or —COO—$(CH(CH_3)—CH_2—O)_n$—Z, where n=0,1,2 or 3 and Z being a 1 to 4 carbon atom alkyl group.

3. The photographic elements of claim 1, where the yellow filter dye is represented by the formulas:

I-1

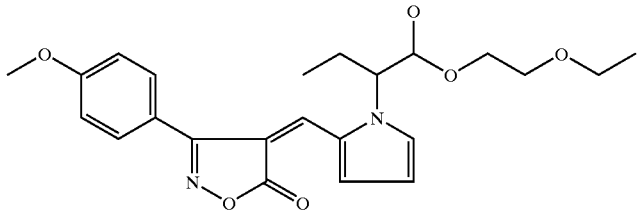

,

I-2

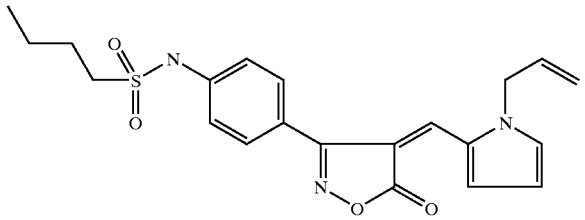

,

I-3

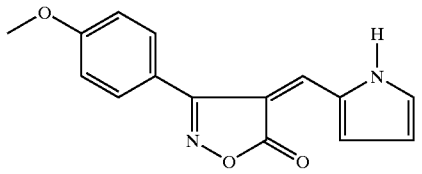

,

I-4

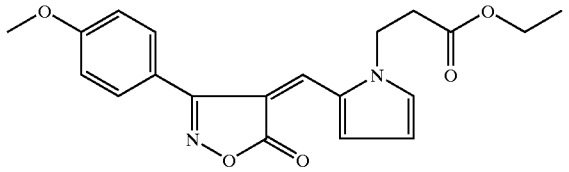

,

I-5

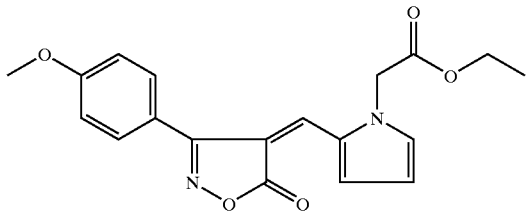

,

-continued

I-6

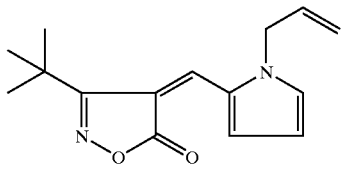

or

I-7

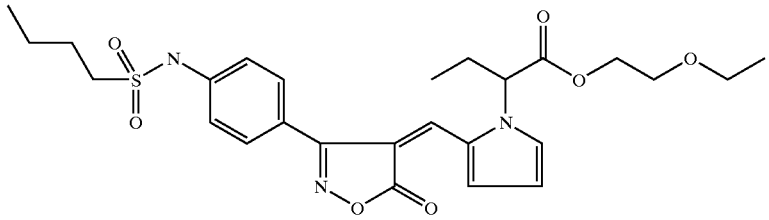

4. The photographic elements of claim 1, where the yellow filler layer comprises from 0.1 to 1.0 g/m$^2$ of yellow filter dye.

5. A silver halide multilayer color photographic element comprising a support having coated thereon in the indicated order starting from the base: at least one red-sensitive silver halide emulsion layer associated with cyan color forming non-diffusing couplers, at least one green-sensitive silver halide emulsion layer associated with magenta color forming non-diffusing couplers, a yellow filter layer, and at least one blue-sensitive silver halide emulsion layer associated with yellow color forming non-diffusing couplers, where the yellow filter layer contains a yellow filter dye represented by the formula:

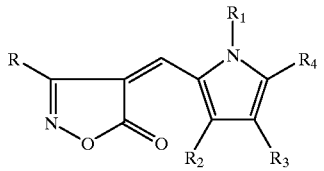

wherein R and $R_1$ each independently represent a hydrogen atom, an alkyl group, an alkylene group, a heterocyclic group or an aryl group; $R_2$, $R_3$ and $R_4$ each represent a hydrogen atom, an alkyl group, or an aryl group and $R_3$ and $R_4$ may be combined to form a 6-membered ring.

6. A multilayer color photographic element according to claim 5, where:

such at least one red-sensitive silver halide emulsion layer comprises in the order an upper red-sensitive silver halide emulsion layer, an intermediate and a lower layer all sensitive to the same spectral region of visible light, where the sensitivity of the three red-sensitive silver halide emulsion layers decreases starting from the upper silver halide emulsion layer to the lower silver halide emulsion layer, such at least one green-sensitive silver halide emulsion layer comprises in the order of an upper green-sensitive silver halide emulsion layer, an intermediate and a lower layer all sensitive to the same spectral region of visible light, where the sensitivity of the three green-sensitive silver halide emulsion layers decreases starting from the upper silver halide emulsion layer to the lower silver halide emulsion layer, and such at least one blue-sensitive silver halide emulsion layer comprises in the order an upper and a lower blue-sensitive silver halide emulsion layer all sensitive to the same spectral region of visible light, where the sensitivity of both blue-sensitive silver halide emulsion layers decreases starting from the upper silver halide emulsion layer to the lower silver halide emulsion layer.

* * * * *